United States Patent [19]

Habelt et al.

[11] Patent Number: 4,496,257

[45] Date of Patent: Jan. 29, 1985

[54] TRANSPORT ROLLER FOR A RECORD CARRIER IN A PRINTER

[75] Inventors: Gerhard Habelt; Franz Mucha, both of Vienna, Austria

[73] Assignee: U.S. Philips Corporation, New York, N.Y.

[21] Appl. No.: 571,401

[22] Filed: Jan. 17, 1984

Related U.S. Application Data

[63] Continuation of Ser. No. 403,174, Jul. 29, 1982, abandoned.

[51] Int. Cl.[3] ..... B41J 13/02; B41J 15/02

[52] U.S. Cl. ..... 400/578; 29/121.1; 118/DIG. 15; 193/37; 226/190; 226/193

[58] Field of Search ..... 400/578, 659, 661.3; 118/DIG. 14, DIG. 15; 29/121.1, 121.3, 123, 125; 193/35 R, 37; 198/779, 780; 226/189, 190, 193, 168; 271/264, 272, 314

[56] References Cited

U.S. PATENT DOCUMENTS

| | | | |
|---|---|---|---|
| 752,329 | 2/1904 | Clegg | 29/123 X |
| 1,470,558 | 10/1923 | Fuller | 193/35 R |
| 1,824,470 | 9/1931 | Fahrenwald | 29/121.6 X |
| 1,849,287 | 3/1932 | Fahrenwald | 29/121.6 X |
| 2,218,817 | 10/1940 | Frost | 29/125 X |
| 2,650,603 | 9/1953 | Howes | 193/37 X |
| 2,897,953 | 8/1959 | Namenyi-Katz | 198/780 |
| 3,042,397 | 7/1962 | Tarbuck | 271/264 |
| 3,964,658 | 6/1976 | Edwards | 29/125 |

FOREIGN PATENT DOCUMENTS

| | | | |
|---|---|---|---|
| 1401083 | 4/1965 | France | 118/DIG. 15 |

*Primary Examiner*—Edgar S. Burr
*Assistant Examiner*—David A. Wiecking
*Attorney, Agent, or Firm*—David R. Treacy

[57] ABSTRACT

A transport roller for a record carrier in a printer, for example, an ink jet printer, is composed of at least two laterally adjoining, hollow, cylindrical roller sections. Each roller section is connected to its hub by means of at least one carrier portion. The roller sections are adjacently arranged on a shaft by way of the hubs by which they are locked against rotation. At a first lateral end of each roller section a groove opens towards this first end, in which groove there is arranged a toroidal ring. The laterally open groove is closed by the second lateral end of the roller section which adjoins this first lateral end.

8 Claims, 3 Drawing Figures

TRANSPORT ROLLER FOR A RECORD CARRIER IN A PRINTER

This is a continuation of application Ser. No. 403,174, filed July 29, 1982 now abandoned.

BACKGROUND OF THE INVENTION

The invention relates to a transport roller for a record carrier in a printer, said transport roller comprising toroidal rings which are adjacently arranged at a distance from one another in the longitudinal direction of the roller axis, each of said rings being arranged in a groove on the circumference for guiding the record carrier. Such toroidal rings are often referred to as O-rings. The rolling body of such a transport roller in commercially available printers consists of one piece. This creates a manufacturing problem because the grooves for the toroidal rings (which must be proportioned comparatively accurately) must be subjected to a special treatment, so that all toroidal rings will occupy exactly the same position with respect to the circumferential surface of the rolling body in order to ensure that the path of the record carrier around the transport roller is uniformly cylindrical across the entire length of the roller. Only in this way is it then ensured that the path of the record carrier behind the transport roller is regular and exactly defined. This is important, for example, when after departure from the transport roller, the record carrier is fed to a flat supporting surface along which a printing head of a printer is guided to be displaceable in the line direction; in such a case the record carrier must rest flatly on the supporting surface in order to ensure that the distance between the printing head and the record carrier remains constant. This requirement must be satisfied, for example, in the case of ink jet printing heads.

SUMMARY OF THE INVENTION

It is an object of the invention to construct a transport roller of the kind set forth so that it can be simply and cheaply manufactured, notably in bulk, without special treatments being required, while the path of the record carrier around the transport roller is still regular and exactly defined.

To this end, the transport roller in accordance with the invention is characterized in that it comprises at least two laterally adjoining, mainly hollow, cylindrical roller sections, a hub portion being connected to the rest of each roller section via at least one carrier. The roller sections are adjacently arranged on a shaft by way of their hubs so that they are locked against rotation and are pressed against one another by means of a clamping device. Each roller section includes one of the grooves, which is provided at a first lateral end of the roller section and which is open towards this first lateral end, the roller section adjoining this first lateral end closing the open side of the groove by way of its second lateral end. Because the transport roller is composed of several roller sections, the individual roller sections are accordingly short, so that each section can be simply manufactured with high precision. For example, the separate roller sections can be very cheaply and simply made of a plastic by injection molding. Furthermore, the mounting of the toroidal rings is very simple, because they can be readily arranged in the laterally open groove of each roller section.

For the construction and arrangement of the hub and the carrier connecting the hub to the hollow cylindrical roller section a series of possibilities exist within the range of the customarily used techniques. For example, for the accurate and stable journalling of a roller section on the shaft, use can be made of a hub which extends approximately over the full length of the roller section and which is connected to the hollow cylindrical roller section via a partition-like transverse wall which acts as a carrier. A preferred embodiment of the transport roller in accordance with the invention is characterized in that the hub of a roller section is arranged near the second lateral end, the hub projecting beyond this second lateral end, viewed in the axial direction. The carrier for the hub connects to the rest of roller section near the first lateral end and encloses a coaxial recess for accommodating the hub of the roller section adjoining this first lateral end, the internal dimension of said coaxial recess corresponding to the external dimension of the hub. Each hub can thus be constructed to be comparatively short; accurate journalling of each roller section, however, is still obtained because the hub of one roller section serves also as a journal for the second roller when two roller sections are arranged one behind the other; thus, each roller section is actually journalled twice. Because a bearing for the roller section is situated near each toroidal ring, it is ensured that the toroidal rings are very exactly positioned. It is a further advantage that the precision manufacture of shorter hubs is easier.

The carrier which connects the hub to the roller section may be constructed, for example, as a solid body. In view of a simple but stable construction and ease of manufacturing, the hub is preferably connected to the roller section by way of at least three spoke-like carriers.

The invention will be described in detail hereinafter with reference to the drawing which shows an embodiment in accordance with the invention.

DESCRIPTION OF THE PREFERRED EMBODIMENT

Figure 1:
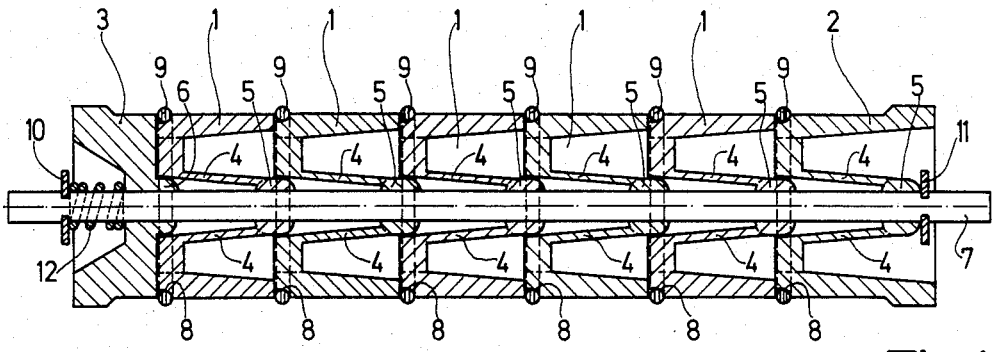
FIG. 1 is a longitudinal sectional view of a transport roller consisting of several roller sections.

The transport roller shown in FIG. 1 consists of five identical, hollow, cylindrical roller sections 1 and two roller end sections 2 and 3. The construction of the roller end section 2 is quite similar to that of the roller sections 1. The roller sections 1 and the roller end section 2 are each connected to hub portions 5 via carrier portions 4. The roller end section 3 also comprises a hub 6. The roller sections 1 and the roller end sections 2 and 3 are adjacently arranged on a shaft 7 by way of the hubs 5 and 6 so that they are locked against rotation, the roller end sections 2 and 3 constituting the lateral ends of the transport roller. All roller sections are locked against rotation, for example, in that the shaft 7 consists of a profiled rod on which the correspondingly shaped hubs of the roller sections are fitted. Between each pair of laterally adjacent roller sections 1 and also between the roller end sections 2 and 3 and the adjacent roller sections 1 there is provided a toroidal ring 9 which is arranged in a groove 8 at the circumference of the roller sections 1 and the roller end section 2. The roller sections 1 and the roller end sections 2, 3 are clamped together by means of an axial clamping device which comprises two discs 10 and 11 which are arranged on the shaft 7 at an axial distance from one another and an intermediate spring 12 which bears on the one side against the disc 10 and on the other side against the roller end section 3, the hub 5 of the roller end section 2 bearing against the disc 11. The roller sections 1 and the roller end sections 2 and 3 are thus pressed against one another by way of their lateral ends. The transport roller thus constitutes one structural unit which can be rotatably journalled, for example, in a printer by way of the free ends of the shaft 7. Such a transport roller then serves, for example, for the continuous or intermittent feeding of a sheet-like record carrier. The record carrier can then also be pressed by means of pressure rollers which cooperate with the toroidal rings in order to ensure correct transport. The roller end sections 2 and 3 may also be constructed as so-called spiked rollers for the transport of a record carrier comprising a perforated edge.

Figure 2:
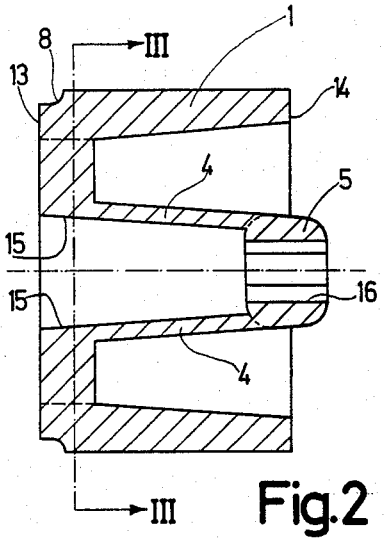
FIG. 2 is a longitudinal sectional view at an increased scale of a single roller section of the transport roller shown in FIG. 1.
Figure 3:
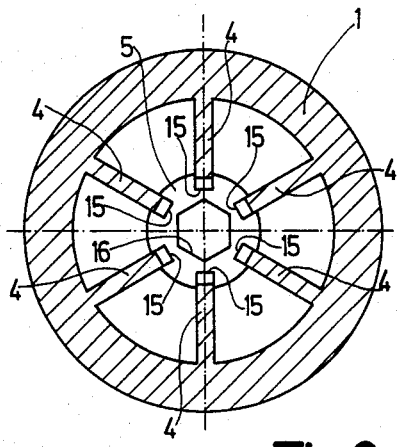
FIG. 3 is a cross-sectional view of the roller section shown in FIG. 2.

FIGS. 2 and 3 show a roller section 1 including its hub 5 connected via the carrier 4 in greater detail. It is clearly shown that each roller section 1 comprises, at a first lateral end 13 (the left end in FIG. 2), a groove 8 which opens towards the first lateral end 13 and has a side toward the second lateral end of that section, and which is closed by the second lateral end 14, situated opposite the first lateral end 13, of an adjacently situated roller section, so that a toroidal ring arranged in the groove 8 is suitably positioned.

In the described embodiment, the hub 5 of a roller section 1 is situated near the second lateral end 14 and projects beyond this second lateral end, viewed in the axial direction. The hub 5 is connected to the roller section 1 by way of six spoke-like carriers 4. The carriers 4 are connected to the roller section 1 near the first lateral end 13. Near this first lateral end the carriers enclose a coaxial recess 15 whose internal dimension corresponds to the external dimension of the hub 5. The recess 15 serves to accommodate the hub 5 of the next roller section which adjoins the first lateral end 13, the part of the hub 5 which projects beyond the second lateral end 14 of the next roller section then being situated in the recess 15. Near the first end 13 the carriers 4 thus bear on the hub 5 of the adjacent roller section 1, so that a double bearing is obtained for each roller section, on the one hand via its own hub 5 and on the other hand via the hub 5 of the adjacent roller section. The same is applicable to the roller end section 2 and the roller section 1 adjoining the roller end section 3, because the hub 6 of the roller end section 3 engages in the recess 15 thereof. Because all bearings are effective near the first end 13 with the groove 8 of each roller section, a suitable support is obtained near the grooves 8 for all roller sections, so that the radial position of the toroidal rings 9 arranged in the grooves 8 is accurately defined. A very exact and uniform path of the record carrier around the transport roller is thus obtained; this is particularly important, for example, when the record carrier is fed from the transport roller to a flat supporting surface along which a printing head of a printer is displaced, for example, an ink jet printing head which cooperates with the record carrier.

In the described embodiment, the continuous hub opening or axial hole 16 provided in each hub 5 is hexagonal in order to prevent rotation of the roller sections on the shaft 7 which has a corresponding cross-section. Evidently, other corresponding cross-sections could also be chosen for this purpose, for example, a rectangular cross-section etc. As appears notably from FIG. 2, the hollow cylindrical interior of the roller section 1 and the exterior of the carriers 4 and the hub 5 have a slightly conical shape, so that these parts can be very simply manufactured by means of the injection molding technique. The material used is, for example, a synthetic material so that the manufacture can be simple, accurate and cheap.

Because the transport roller is composed of several short roller sections, each of which is accurately manufactured, all roller sections being accurately journalled at the area of the toroidal rings, the positions of the toroidal rings are accurately defined, so that the sites for the toroidal rings (formed by the grooves) need not be further treated. Consequently, such a transport roller can be very simply and cheaply manufactured, and it still offers suitable transport of the record carrier as well as a regular path thereof around the transport roller.

Obviously, a series of modifications are feasible within the scope of the invention. This is notably applicable to the arrangement and the construction of the hubs and the carriers connecting the hubs to the hollow cylindrical roller sections. In this respect it is to be noted that at the areas where the roller sections laterally adjoin one another, mutually engaging fits or supports may be provided.

What is claimed is:

1. A transport roller for a record carrier in a printer, comprising a plurality of toroidal rings spaced axially from one another along the longitudinal axis of the roller, and a ring support having a corresponding plurality of circumferential grooves, each ring being arranged in a respective groove, characterized in that the roller further comprises a shaft, and said ring support comprises a corresponding plurality of laterally adjoining, mainly hollow, cylindrical roller sections having first and second lateral ends, a hub portion and a carrier portion, each hub portion has an axial hole therethrough through which the shaft is fitted for locating each of said sections radially and locking the hub portion against relative rotation with respect to the shaft, each carrier portion extends between the hub portion and the first lateral end, the first lateral end of each roller section has an inwardly extending groove about the circumference, the groove having a sidewall at the groove side toward the second lateral end, and being open toward the first lateral end, said ring arranged in each groove being positioned radially by the respective groove, and the adjoining roller section second lateral end forms the other sidewall of the groove.

2. A roller as claimed in claim 1, characterized in that each carrier portion extends axially between the hub portion and first lateral end, and is spaced radially from the shaft.

3. A roller as claimed in claim 1, characterized in that each roller section hub is arranged interiorly of and projects axially beyond the second lateral end of that roller section, and the roller section carrier portion has a coaxial recess near the first lateral end of the roller section, for accommodating the hub of the roller section adjoining this first lateral end, the internal dimension of said coaxial recess corresponding to the external dimension of the hub.

4. A roller as claimed in claim 3 characterized in that the carrier portion comprises at least three spoke-like carriers.

5. A roller as claimed in claim 2, characterized in that the carrier portion comprises at least three spoke-like carriers.

6. A roller as claimed in claim 1, characterized in that the carrier portion comprises at least three spoke-like carriers.

7. A transport roller for a record carrier in a printer, comprising a plurality of toroidal rings spaced axially from one another along the longitudinal axis of the roller, and a ring support having a corresponding plurality of circumferential grooves, each ring being arranged in a respective groove, characterized in that the roller further comprises a shaft, and said ring support comprises a corresponding plurality of laterally adjoining, mainly hollow, axially assymmetric cylindrical roller sections having first and second lateral ends, a hub portion and a carrier portion, each hub portion has an axial hole therethrough through which the shaft is fitted for locating the respective hub portion radially and locking the hub portion against relative rotation with respect to the shaft, each carrier portion extends between the hub portion and the first lateral end, each of said grooves has a bottom portion and two sides, said bottom portion and one of said sides being formed by an inwardly extending groove about the circumference of the first lateral end of each roller section, said inwardly extending groove being open toward the first lateral end; and the other side being formed by the second lateral end of the respective adjoining roller section, whereby each of said rings is supported and positioned radially by only said bottom portion formed in the first lateral end of the respective roller section.

8. A roller as claimed in claim 7, characterized in that each carrier portion extends axially between the hub portion and first lateral end of its respective roller section, and is spaced radially from the shaft, and the roller further comprises means for radially positioning the first lateral end of one roller section by engaging the hub of the adjoining roller section whose second lateral end forms the side of the groove in said one roller section, whereby each toroidal ring is positioned with respect to the shaft by the first lateral end of the roller section against whose groove bottom portion the ring engages, and the hub of the adjoining roller section whose second lateral end forms the side of the groove in which the toroidal ring is arranged.

* * * * *